US006149236A

United States Patent [19]

Bräuning

[11] Patent Number: 6,149,236

[45] Date of Patent: Nov. 21, 2000

[54] CHAIR FRAME, CONTROL MECHANISM AND UPHOLSTERY

[75] Inventor: Egon Bräuning, Weil am Rhein, Germany

[73] Assignee: Vitra Patents AG, Muttenz, Switzerland

[21] Appl. No.: 09/284,393

[22] PCT Filed: Oct. 3, 1997

[86] PCT No.: PCT/IB97/01202

§ 371 Date: Apr. 13, 1999

§ 102(e) Date: Apr. 13, 1999

[87] PCT Pub. No.: WO98/16140

PCT Pub. Date: Apr. 23, 1998

[30] Foreign Application Priority Data

Oct. 14, 1996 [CH] Switzerland ..... 2507/96

[51] Int. Cl.[7] ..... A47C 1/024

[52] U.S. Cl. ..... 297/301.2; 297/301.1

[58] Field of Search ..... 297/291, 301.1, 297/301.2, 301.4, 344.19, 344.18, 452.18

[56] References Cited

U.S. PATENT DOCUMENTS 4,408,800 10/1983 Knapp .
4,521,053 6/1985 De Boer .
4,589,697 5/1986 Bauer et al. .
5,069,496 12/1991 Kunh et al. .
5,577,804 11/1996 Tedesco .
5,725,276 3/1998 Ginat .

FOREIGN PATENT DOCUMENTS 1224708 7/1987 Canada ..... 297/301.2
2434104 2/1975 Germany .
568738 11/1975 Switzerland .
582498 12/1976 Switzerland .

*Primary Examiner*—Milton Nelson, Jr.
*Attorney, Agent, or Firm*—Selitto & Associates

[57] ABSTRACT

The chair has a swiveling back (3, 4) whose rotational axis (D) defines a rear area on the seat (D) with a support (G) for the posterior. A section (32) of the back (3, 4) of the frame extends to the rotational axis (D) where it is connected to the seat support (2) by a single hinge (V). The upholstery is fastened to the seat support (2) in a single piece (8) extending from the seat via the rotational axis (D) to the frame section (30) behind the support for the posterior. The swiveling back consists of a rear support (3) connected by a hinge (V) and a stirrup-shaped tensioner (4) which is secured to said support and which can be inserted into upholstered part (8) of the back. The single-piece upholstery (8) stretches over both the seat and back (3). The rear support (3) has a cross bar (30) to which the upholstery is fastened and from which it extends over the back (3, 4).

11 Claims, 7 Drawing Sheets

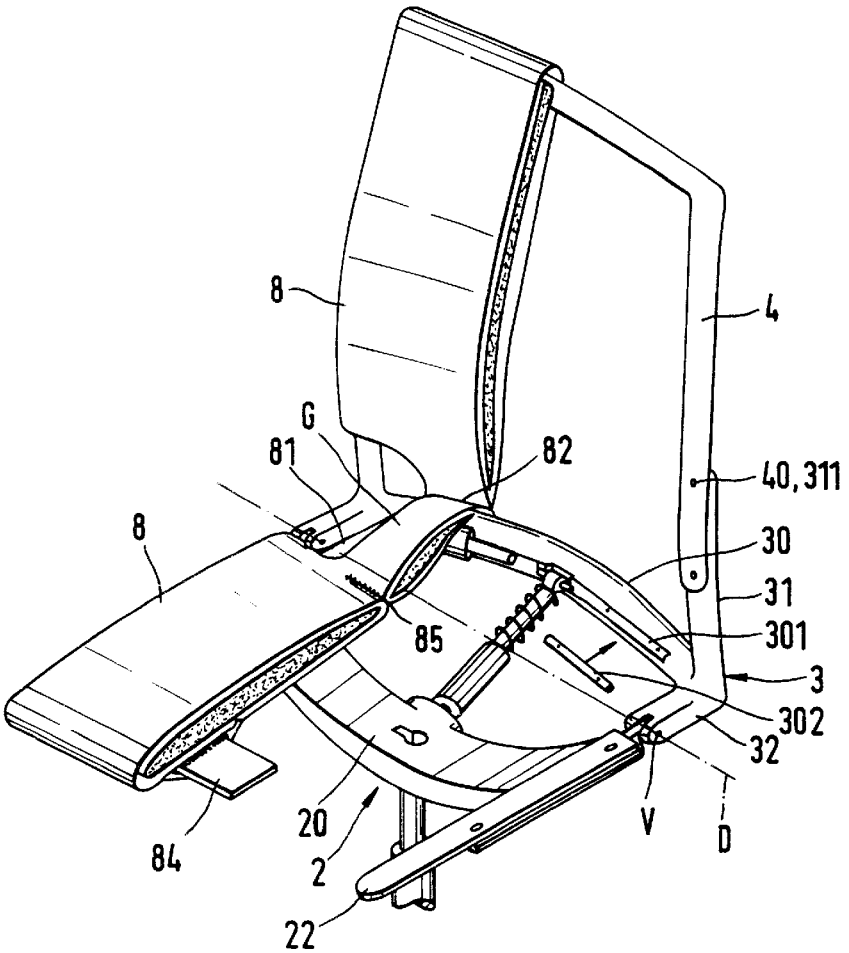
Fig.3A
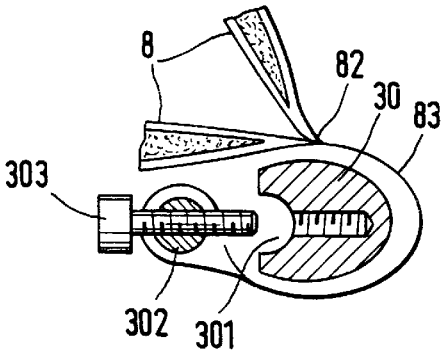
Fig.3C
Fig.3B
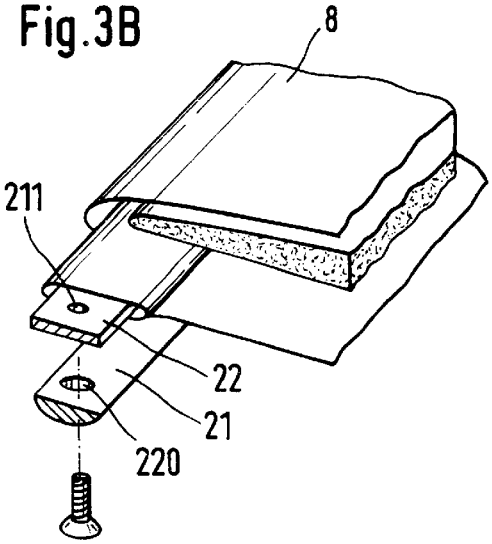

CHAIR FRAME, CONTROL MECHANISM AND UPHOLSTERY

TECHNICAL FIELD OF THE INVENTION

The present invention relates to a chair, in particular a swivel chair for the office, with a height-adjustable seat surface and a backrest which can be adjusted in terms of inclination and is articulated in the plane of the seat surface so as to provide a fixed region for the thigh support and pivotable region for the posterior support. This gives a pivot axis which runs over the width of the seat surface and is obtained by articulation connections on the frame. The padded covering of the seat surface extends from the front edge to beyond the pivot axis. The entire chair mechanism is arranged beneath the seat. Both the height adjustment and the inclination adjustment are realized by means of springs, preferably pneumatic springs, arranged in the frame. In order to optimize the inclination-movement sequence and to set a level of prestressing along with the pneumatic spring, it is common practice to provide an additional helical compression spring. The pneumatic springs are actuated via adjusting levers which are positioned beneath the seat surface and to which the user has access when seated Depending on the previous position of the spring used for the inclination, the actuation of said spring either locks the current position of the back rest, which is lengthened, as it were, up to the pivot axis in the seat surface, or cancels the locking action. Once the locking action of the inclination adjustment has been released, it is possible for one to change the position of the backrest within an adjustment range by shifting one's body weight, the posterior support following the adjustment. Chairs which are fitted out in this way allow sitting postures from a forwardly inclined position (writing position), via a central position (basic position), to a rearwardly inclined position (relaxing position). Chairs of this type provide increased comfort for the user since the backrest and posterior support are advantageously adapted in ergonomic terms to the sitting posture assumed in each case.

PRIOR ART

The principle of subdividing the seat surface into a fixed thigh support and a pivotable posterior support, which passes into the backrest, is known from CH-A-568 738. The subdivision is realized using hinge elements which are arranged in the side parts of the supporting frame.

A chair of the relevant type is disclosed in CH-A-582 498. However, this design is likewise restricted to the pivotability of the backrest, which is connected to the posterior support, it being additionally proposed here for the covering of the seat surface to be continued, beyond the pivot axis, as far as the rear part of the frame. A pneumatic spring is indeed used for the inclination adjustment, but no provision is made for the possibility of height adjustment, an integrated, complete adjusting mechanism and a frame structure and padded covering which satisfy current production requirements and esthetic considerations.

OBJECT OF THE INVENTION

The object of the invention, for a chair with a pivot axis running over the seat surface, is thus to provide an improved frame structure and a combined adjusting mechanism which makes all modern functions possible. In terms of its basic structure, the chair mechanism is intended to be as straightforward as possible, functionally reliable, low maintenance and convenient to operate. Furthermore, the adjusting mechanism which is to be proposed is to be concealed, as a compact structure, in the chair. In the development, the padded covering in functional interaction with the frame structure has particular significance, i.e. it results in rational and cost-effective production and fitting in series manufacturing while at the same time fulfilling current, creative esthetic requirements.

SUMMARY OF THE INVENTION

The seat support of the chair frame is positioned on the conical tip of a pneumatic spring which is arranged vertically and centrally in an underframe which is known per se, the pneumatic spring being provided for the height adjustment and being referred to hereinbelow as height-adjustment pneumatic spring. Articulated on the seat support is the pneumatic spring for the inclination adjustment, which is referred to hereinbelow as inclination-adjustment pneumatic spring and is also articulated on the rear support. The rear support is articulated on the seat support within the pivot axis running over the seat surface and receives the bracket-like rear tensioner. The diametrically opposite operating levers for the vertical-adjustment pneumatic spring and inclination-adjustment pneumatic spring are arranged beneath the seat support.

The rear tensioner and two strip-like seat tensioners can be pushed into the padded covering, the rear tensioner being fastened on the rear support and the seat tensioners being fastened on the seat support. The padded covering, which extends from the seat surface, via the crossmember of the rear support, as far as the rear tensioner, has an extension, in the region of the crossmember, which is wrapped around the crossmember and is fixed thereon.

The invention, then, makes available a relatively straightforward and compact adjusting mechanism which is integrated in the frame structure, which is advantageous for fitting the padded covering thereon. The functionally optimized design and the costeffective fitting achieved mean that the entire chair can be produced in large numbers at efficient manufacturing cost. The adjusting mechanism ensures a long service life, allows straightforward servicing and provides the user with all the advantages of modern seating furniture, including ergonomic adaptation of the posterior support and backrest when the user is changing his/her sitting posture, Along with the lowest possible outlay in terms of materials, the design features provide a chair which is rendered esthetically pleasing by virtue of its simplicity.

BRIEF DESCRIPTION OF THE DRAWINGS AND DETAILED DESCRIPTION OF THE INVENTION

The detailed description of example embodiments in relation the frame structure according to the invention, the adjusting mechanism and the padded covering is given hereinbelow with reference to the attached drawings, in which:

FIG. 3A shows a partial section of the frame structure with padded covering fitted thereon FIG. 3B shows a partial section of the padded covering in the region of the seat support;

FIG. 3C shows the fastening of the padded covering on the crossmember of the rear support as a sectional illustration;

FIGS. 1A to 2A

Figure 1A:
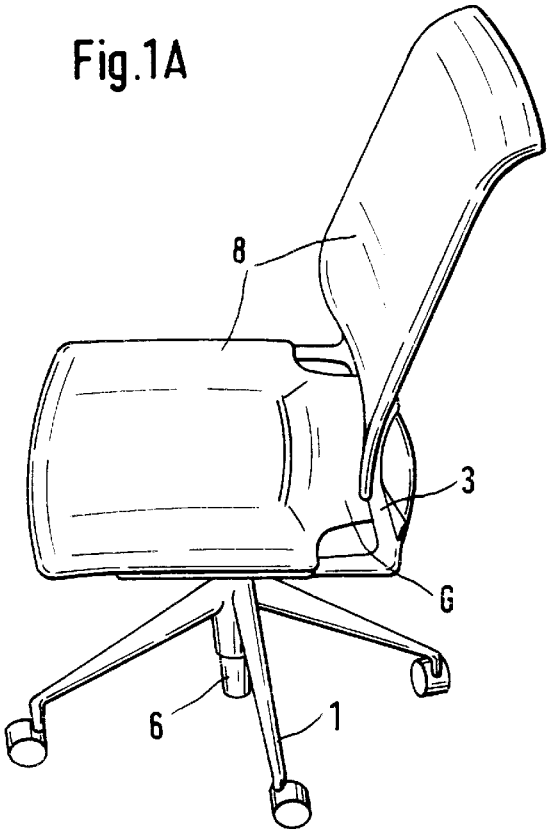
FIG. 1A shows the perspective view of the chair as a whole.
Figure 1B:
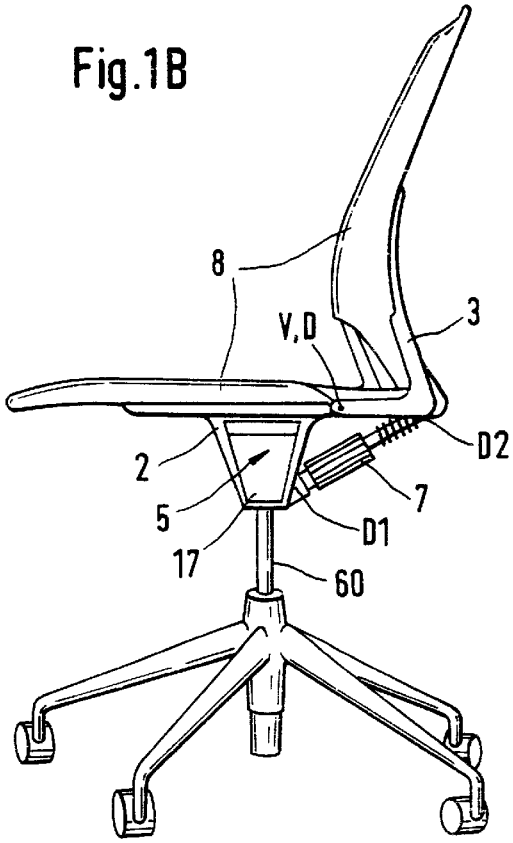
FIG. 1B shows the side view of the chair according to FIG. 1A.

The chair is made up, in principle, of the star-shaped underframe 1, the seat support 2, the rear support 3, the rear tensioner 4, the adjusting mechanism 5, the height-adjustment pneumatic spring 6, the inclination-adjustment pneumatic spring 7 and the padded covering 8. Extending from the underframe 1 is a centrally arranged middle column 10 which rises up vertically and in which there is inserted the height-adjustment pneumatic spring 6 for height-adjustment purposes. The seat support 2 is positioned on the top, conical end of the extensible piston rod 60 of the height-adjustment pneumatic spring 6. The seat support 2, the rear support 3 and the rear tensioner 4 are covered by the single-piece padded covering S.

On the rear side of the seat support 2, in the center, the obliquely upwardly rising inclination-adjustment pneumatic spring 7 is articulated in the axis of rotation D1. The other end of the inclination-adjustment pneumatic spring 7 is articulated centrally on the crossmember 30 of the rear support 3, this resulting in the axis of rotation D2. Extending to the outside of the crossmember 30 are two vertical supports 31, which rise upward, and two horizontal arms-32, which project virtually at right angles, this resulting in a single-piece rear support 3. Right at the front, the arms 32 are connected to the seat support 2 in hinge connections V, with the result that the main axis of rotation D is formed here, it being possible for the rear support 3 to be pivoted as a whole about said main axis of rotation. The region between the main axis of rotation D and the crossmember 30 constitutes the posterior support G. The bracket-like rear tensioner 4 is fastened on the supports 31.

The single-piece, solid seat support 2 essentially comprises a bracket part 20 which is bent open in the upward direction and has support strips 21 which each adjoin at right angles on the outside, are oriented in the forward direction and are rejoined at the rear by the arms 32 in the hinge connections V. A through-passage 200 is located in the center of the base of the bracket part 20. Arranged beneath the bracket part 20, and partially embedded in the same, are the mutually opposite changeover levers 16,17 for the height-adjustment pneumatic spring 6 and the inclination-adjustment pneumatic spring 7.

The following applies to the rest of the description. If, in order to avoid ambiguity in the drawings, a figure contains designations but these designations are not explained in the directly associated text of the description, then you are referred to the point at which said designations have been mentioned in prior figure descriptions. For reasons of clarity, components are not usually designated again in subsequent figures, provided that it is clear from the drawings that they are "recurring" components.

Figure 2A:
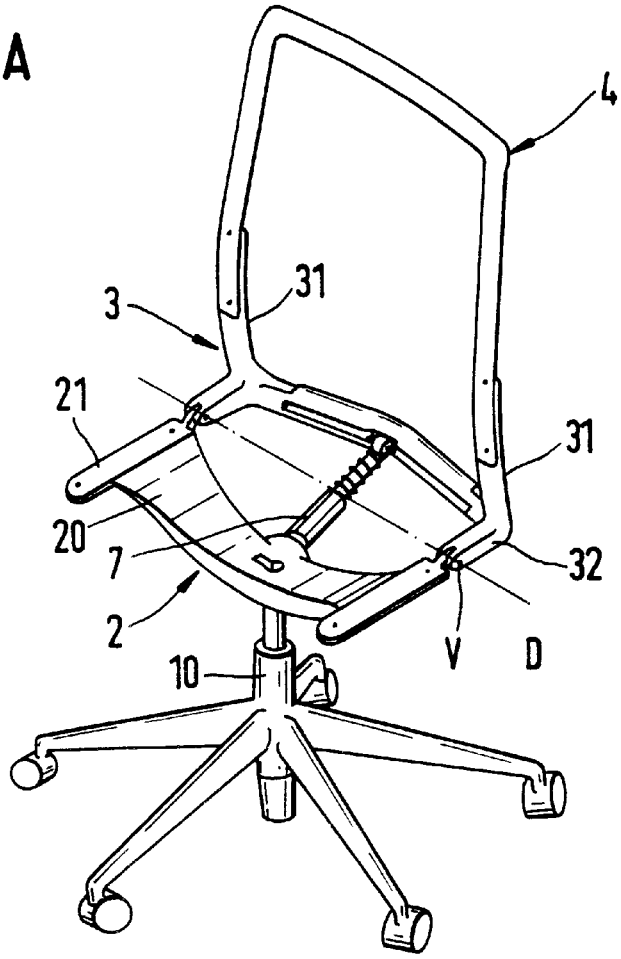
FIG. 2A shows the frame structure of the chair without padded covering.
Figure 2F:
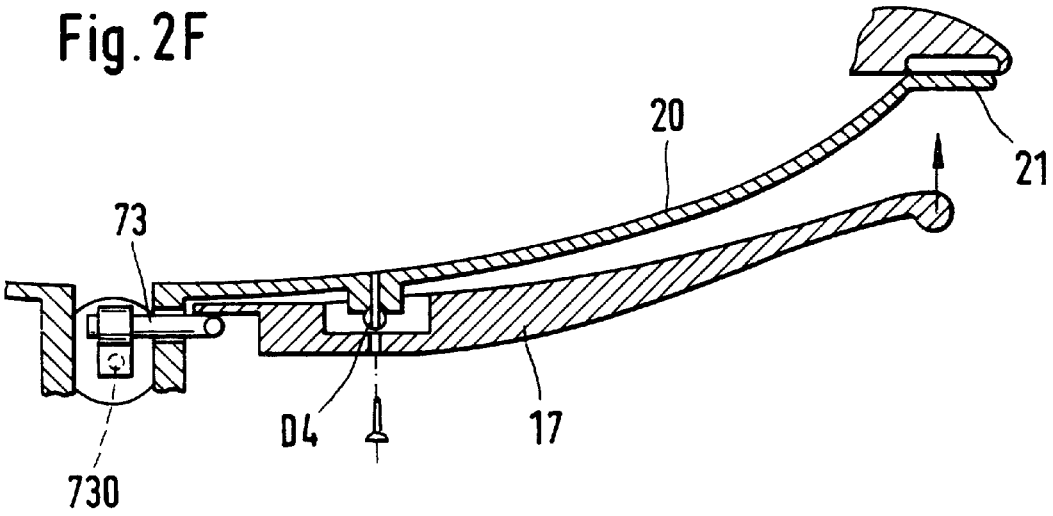
FIG. 2F shows a sectional illustration of the changeover lever according to FIG. 2E.
Figure 2B:
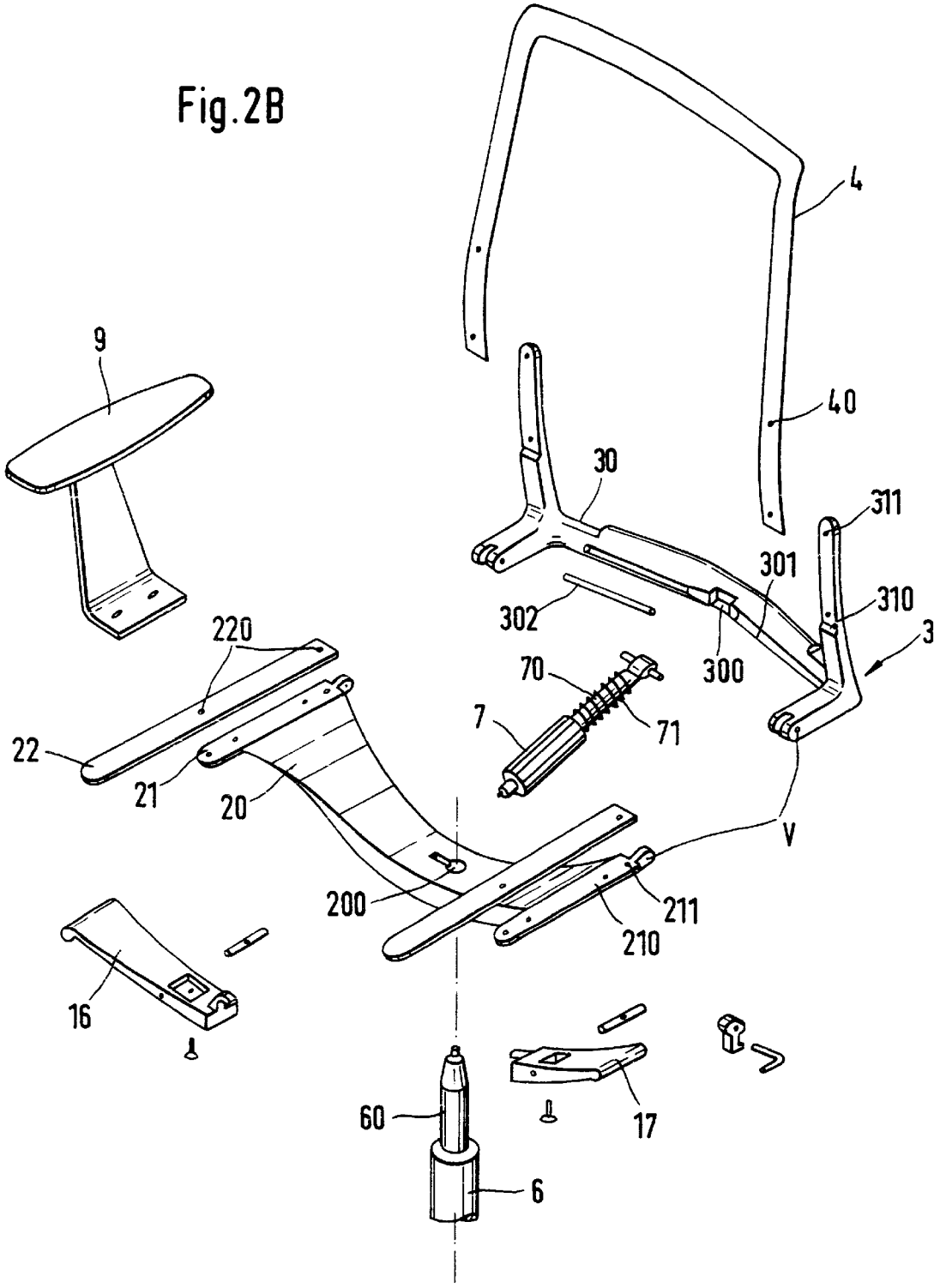
FIG. 2B shows an exploded illustration of the frame structure without underframe.
Figure 2C:
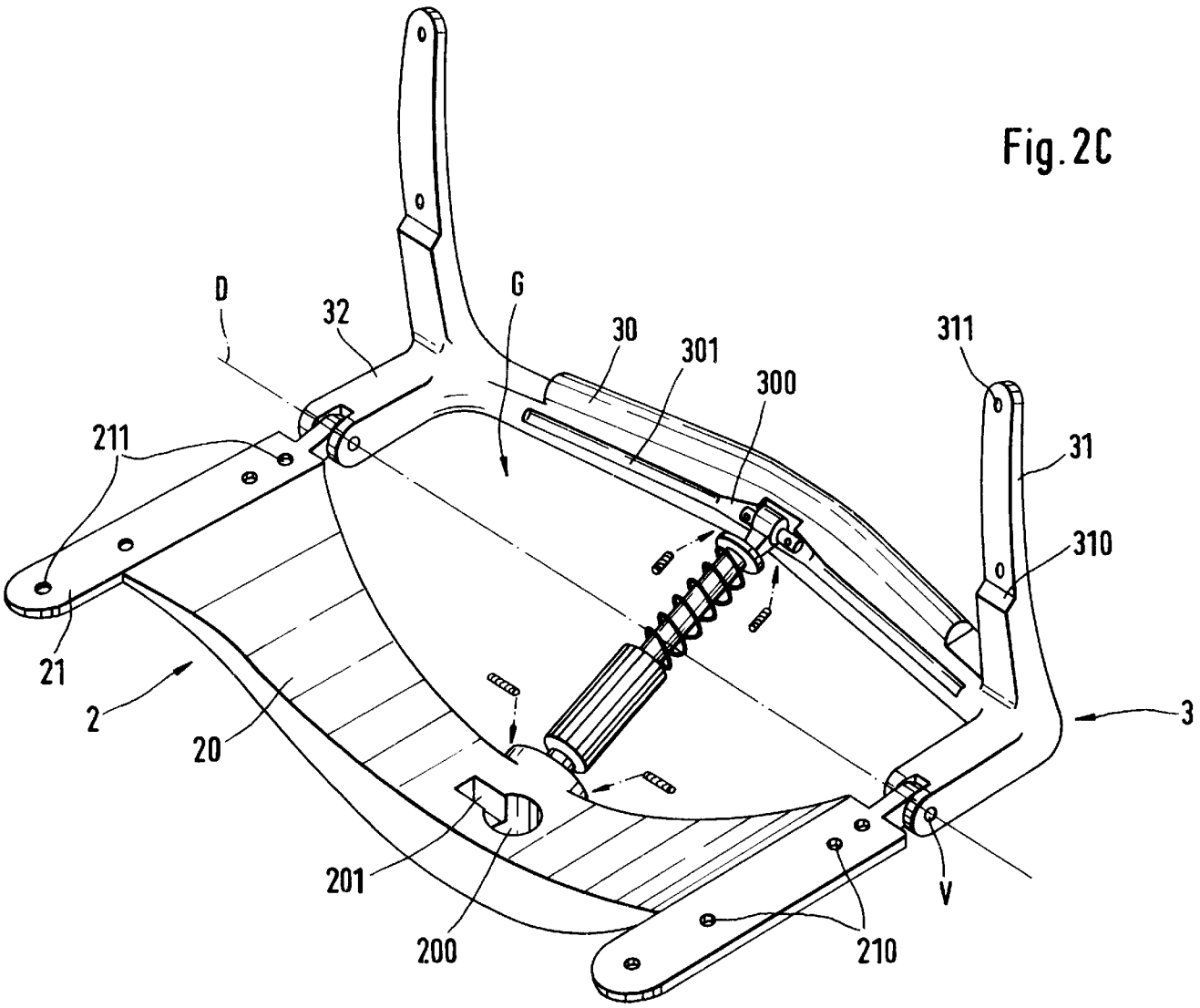
FIG. 2C shows the perspective view of the seat support with the rear support articulated thereon and the inclination-adjustment pneumatic spring.

FIGS. 2B and 2C

The support strips 21 contain pairs of screw holes 210,211 in order to fasten on said support strips the ruler-like seat tensioners 22 and, as appropriate, the armrests 9 which are to be fitted. The seat tensioners 22 thus contain screw holes 220 which correspond with the screw holes 211 in the support strips. The through-passage 200, which is provided on the base of the bracket part 20, has a round bore 201 and an adjoining groove 202, this resulting in a configuration similar to a keyhole. The inclination-adjustment pneumatic spring 7 is articulated on the crossmember 30 in a set-back section 300. For the purpose of influencing the spring characteristics, a helical spring 71 is additionally positioned on the piston rod 70 of the inclination-adjustment pneumatic spring 7. Extending on both sides of the set-back section 300 is a groove 301 which runs longitudinally on the crossmember 30 and is intended for receiving the tensioning bolts 302 used for fastening the padded covering 8. Provided in each vertical support 31 are a positioning shoulder 310, which is directed toward the arms 32, and bores 311.

Figures 2D, 2E:
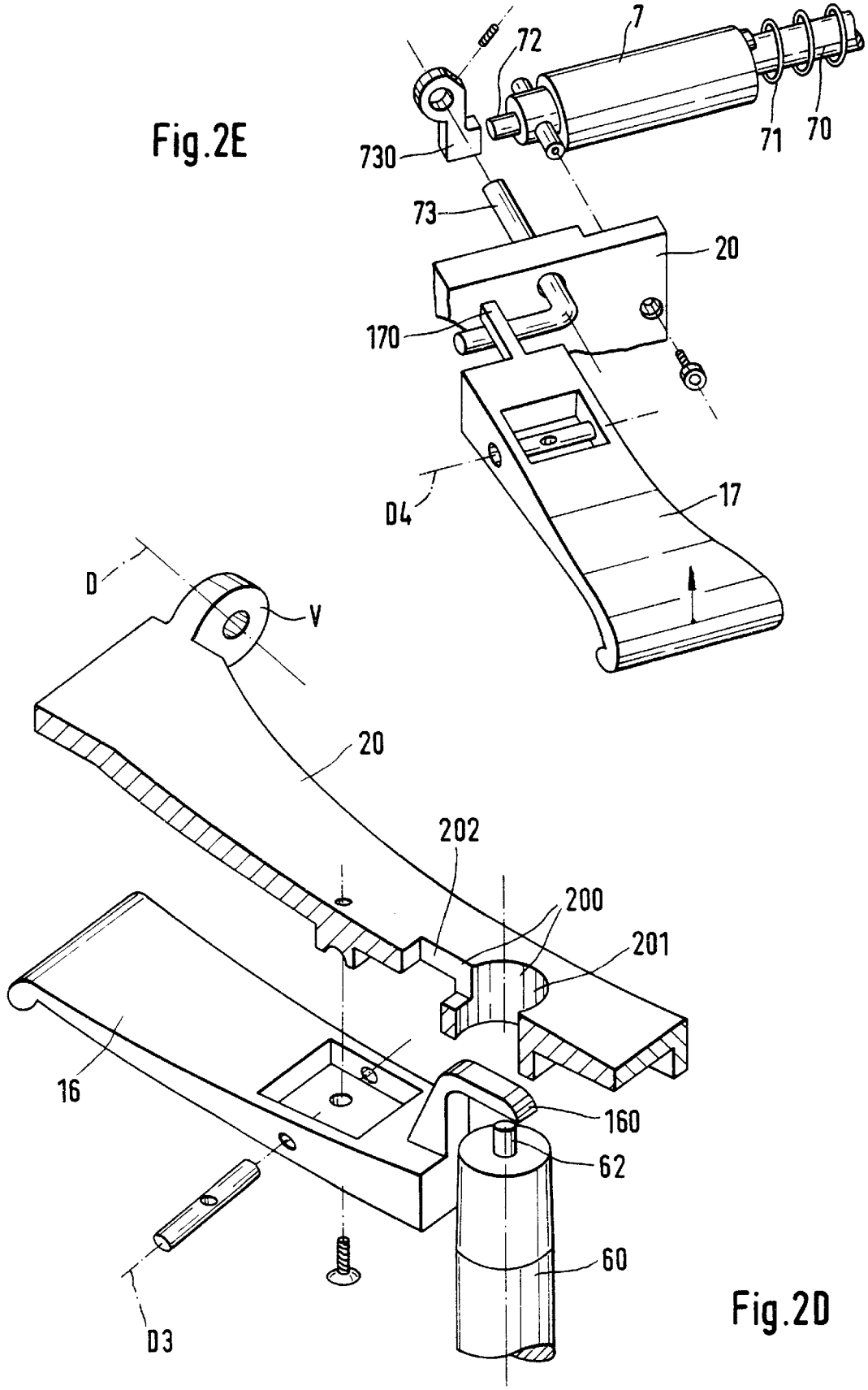
FIG. 2D shows a partial section of the changeover lever which is arranged in the seat support and is intended for the height-adjustment pneumatic spring.
FIG. 2E shows the changeover lever which is arranged in the seat support and is intended for the inclination-adjustment pneumatic spring.

FIGS. 2D to 2F

The changeover levers 16,17 for the purpose of actuating the height-adjustment pneumatic spring 6 and the inclination-adjustment pneumatic spring 7, respectively, are arranged beneath the bracket part 20, in accordance with the shaping of the latter. The top part of the height-adjustment pneumatic spring 6 with the upwardly projecting valve stem 62 is seated in the conical bore 201 of the through-passage 200 of the bracket part 20. The associated changeover lever 16 has a nose 160 and is fixed in an axis of rotation D3. The nose 160 projects, through the groove 202 of the through-passage 200, into the bore 201 of the latter and is located directly above the valve stem 62. If the changeover lever 16 is drawn upward toward the bracket part 20, then the nose 160 moves downward and pushes on the valve stem 62.

The changeover lever 17 for the purpose of actuating the valve stem 72, which projects out of the inclination-adjustment pneumatic spring 7, is fitted, analogously to the lever 16, in an axis of rotation D4. For the purpose of transmitting movement from the changeover lever 17 to the valve stem 72, which is at right angles to the changeover lever 17, use is made of a deflecting angle 73 which is inserted rotatably in the bracket part 20 and on which a catch 730 is located. Upon activation of the changeover lever 171 the nose 170 of the latter is lowered and pushes on the deflecting angle 73, which makes a rotary movement and of which the catch 730 then pushes on the valve stem 72.

FIGS. 3A to 3C

The single-piece padded covering 3 extends from the seat support 2, via the posterior support G of the latter, to the crossmember 30 and over the rear tensioner 4. In the region of each of the support strips 21, the padded covering 8 has a pocket 80, into which the seat tensioners 22 are pushed. These ruler-like or strip-like seat tensioners 22 are then fastened on the support strips 21, and are preferably screwed from beneath through the bores 211,220. Cutouts 81 are provided in the padded covering 8 in the region of the hinge connections V and of the crossover points of crossmember 30, vertical supports 31 and arms 32. Level with the crossmember 30, the padded covering 8 has a branching arrangement 82 from which the padded covering 8 extends further to the rear tensioner 4 and where a strip-like extension 83 is provided. The branching arrangement 82 and the extension 83 may be produced by a second piece of fabric being sewn on.

The padded covering 8 also has a pocket in the region of the rear tensioner 4, and the loose rear tensioner 4 can be pushed into said pocket. The rear tensioner 4, inserted in the padded covering 8 in this way, is then fastened on the vertical supports 31, i.e. positioned and fixed, preferably screwed from the rear, on the positioning shoulders 310. The screw holes 311 and 40 in the vertical supports 31 and in the rear tensioner 4, respectively, are used for this purpose.

The strip-like attachment 83—preferably made of the same material as the padded covering 8—has transversely running loops 830 into which the tensioning bolts 302 can be pushed. From the rear, the attachment 83 is folded downward around the crossmember 30, the tensioning bolts 302 being seated in the grooves 301 and fixed therein, erg. by means of screws 303. For the purpose of stabilizing the padded covering 8, it is possible to provide at the front, in the region of the seat surface, a bottom transverse pocket into which a strip-like, elastic seat tensioner 84 is inserted. It is advantageous for a continuous strengthening seam 85 to be provided in the padded covering 8, more or less following the course of the main axis of rotation D, said strengthening seam dividing the posterior support G from the rest of the seat surface.

Figure 4A:
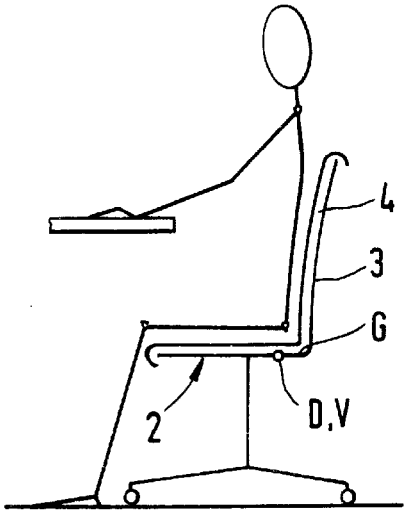
FIG. 4A shows a basic illustration of the chair in the basic position (posterior support horizontal, backrest vertical)
Figure 4B:
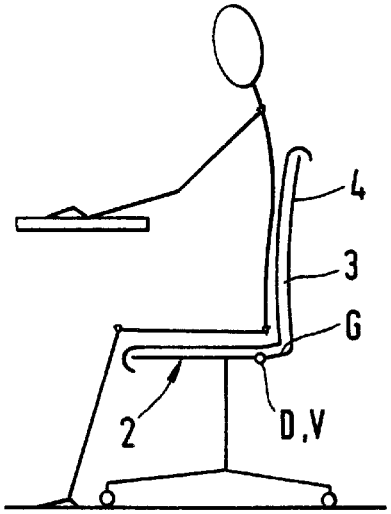
FIG. 4B shows a basic illustration of the chair in the writing position (posterior support and backrest inclined in the forward direction)
Figure 4C:
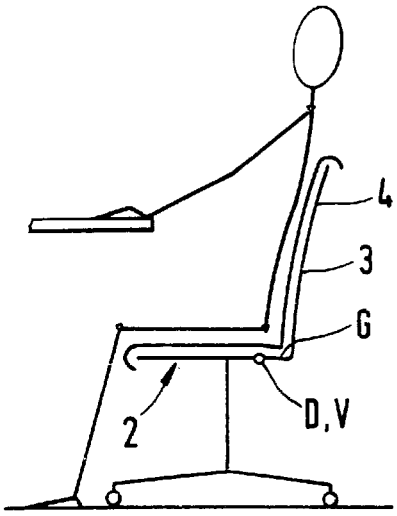
FIG. 4C shows a basic illustration of the chair in the relaxing position (posterior support and backrest inclined in the rearward direction).

FIGS. 4A to 4C

This series of figures illustrates the different positions which the user can assume on a chair which has the features according to the invention.

The desired chair height can only be adjusted if the changeover lever 16 is pushed and thus the length of excursion of the height-adjustment pneumatic spring 6 can be changed. Usually, when the actuating lever 16 is pushed and the seat support 2 is relieved of loading, said seat support is raised to the maximum height. If the seat support 2 has been subjected to loading and the changeover lever 16 has been pushed, then the seat support 2 is moved downward to the lowermost position.

With the inclination adjustment of the posterior support and the back part, which is formed from the rear support 3, the rear tensioner 4 and the padded covering 8, there is a choice between two states. In the first state, the current position is locked, i.e. the inclination-adjustment pneumatic spring 1 is blocked. Upon actuation of the changeover lever 17, the blocking of the inclination adjustment pneumatic spring 7 is canceled and the user, by shifting his/her body weight, can assume, on the chair, any position in the entire range between the forwardly inclined, writing position (according to FIG. 4B), via the central, basic position (according to FIG. 4A), to the rearwardly inclined, relaxing position (according to FIG. 4C). When the changeover lever 17 is operated anew, the current position is locked again.

If the inclination-adjustment pneumatic spring 7 is in the free state, and the user exerts sufficient pressure against the back part, this results in a movement in the main axis of rotation D and the secondary axes of rotation D1 and D2. The inclination-adjustment pneumatic spring 7 and the helical spring 71 change their lengths of excursion. An adequate change in the posterior support follows when the rear support 3 is adjusted in terms of inclination.

What is claimed is:

1. A chair having:

(a) a pivotable back part (3, 4), having an axis of rotation (D) that defines a rear region of a seat surface with posterior support (G), in that a section (32) of a frame of the back part (3, 4) continues as far as the axis of rotation (D) and is articulated there on a seat support (2) in a hinge connection (V); and (b) a single-piece padded covering (8) which is fastened on the seat support (2) and extends from the seat surface, beyond the axis of rotation (D), as far as a crossmember (30) behind the posterior support (G), wherein (c) the pivotable back part comprises a rear support (3), which is articulated in the hinge connection (V), and a U-shaped rear tensioner (4) which is to be fastened over said rear support (3) and inserted into a back part of the padded covering (8); and (d) the single-piece padded covering (8) spans the seat surface and the back part (3, 4), and (e) the rear support (3) has the crossmember (30) on which the padded covering (8) is fastened and passes from there to the back part (3, 4).

2. The chair as claimed in claim 1, wherein (a) on both sides the seat support (2) has two support strips (21) which are provided in extension of arms (32), articulated thereon, of the rear support (3); and (b) the padded covering (8) is fastened on said support strips (21).

3. The chair as claimed in claim 1 or 2, wherein (a) on a rear side of the seat support (2), in the center, an upwardly-oriented pneumatic spring (7) is articulated in an axis of rotation (D1), said upwardly-oriented spring extending to the crossmember (30) and being articulated there likewise in an axis of rotation (D2) and in the center of a bow-shaped base (20) of said seat support, a vertically-oriented spring (6) is affixed to said seat support; and (b) partially embedded in the bow-shaped base (20), beneath the seat support (2), which is open in arc form in the upward direction, are two diametrically opposite changeover levers (16, 17) for the purpose of actuating the springs (6, 7) provided for the height adjustment and for the pivoting movement and (c) provided right at the front of one changeover lever (16) is a nose (160) which acts directly on a valve stem (62) of said vertically-oriented spring (6), while provided on the other changeover lever (17) is a nose (170) which acts on a deflecting angle (73), which bears a fixed catch (730) which pushes on a valve stem (72) of said upwardly-oriented spring (7).

4. The chair as claimed in claim 3, wherein provided in the bow-shaped base (20) is a bore (201) which is located in the center of said base (20) and in which the top part of the height-adjustment pneumatic spring (6) is inserted, the nose (160) projecting into the bore (201) by way of a peripheral groove (202) on the bore (201).

5. The chair as claimed in claim 3, wherein provided in the padded covering (8), in the region of the support strips (21), are pockets into which flat bar seat tensioners (22) are pushed, the seat tensioners (22) being fastened on the top of the support strips (21).

6. The chair as claimed in claim 1 or 2, wherein, in the vicinity of the crossmember (30), the padded covering (8) has a branch arrangement (82) from which the padded covering (8) extends further to the back part (3,4) and there projects a strip extension (83) which is intended for folding over around the crossmember (30) and for fastening thereon.

7. The chair as claimed in claim 6, wherein provided on the edge of the extension (83) are loops into which there are inserted tensioning bolts (302), which are fastened on the crossmember (30).

8. The chair as claimed in claim 7, wherein provided on the crossmember (30) is a longitudinally running groove (301) for the purpose of receiving the tensioning bolts (302).

9. The chair as claimed in claim 6, wherein provided on said crossmember (30) is a longitudinally running groove (301) for the purpose of receiving tensioning bolts (302).

10. The chair as claimed in claim 1, wherein (a) the padded covering (8) has multiple layers and in a region of the front edge of the seat surface, it contains a transversely running elastic seat tensioner (84); and (b) provided in the padded covering (8), at least in the vicinity of the axis of rotation (D), along with the latter, is a strengthening seam (85) which passes through all the layers of the padded covering (8).

11. The chair as claimed in claim 1, wherein the rear tensioner (4), inserted in advance into the padded covering (8), is screwed onto vertical supports (31) of the rear support (3).

* * * * *